US010194747B2

(12) United States Patent
Padagas

(10) Patent No.: US 10,194,747 B2
(45) Date of Patent: Feb. 5, 2019

(54) SALON TREATMENT ASSEMBLY WITH MOVABLE SALON CHAIR COUPLED TO HARD-PLUMBED FOOT BATH

(71) Applicant: Earthlite Massage Tables, Inc., Vista, CA (US)

(72) Inventor: Nicolas Padagas, Carlsbad, CA (US)

(73) Assignee: EARTHLITE, LLC, Vista, CA (US)

( * ) Notice: Subject to any disclaimer, the term of this patent is extended or adjusted under 35 U.S.C. 154(b) by 0 days.

(21) Appl. No.: 15/265,384

(22) Filed: Sep. 14, 2016

(65) Prior Publication Data

US 2017/0086585 A1 Mar. 30, 2017

Related U.S. Application Data

(60) Provisional application No. 62/232,812, filed on Sep. 25, 2015.

(51) Int. Cl.

| | |
|---|---|
| ***A47C 1/11*** | (2006.01) |
| ***A47C 7/54*** | (2006.01) |
| ***A47C 1/06*** | (2006.01) |
| ***E03C 1/14*** | (2006.01) |
| ***A61H 35/00*** | (2006.01) |
| ***A47K 3/022*** | (2006.01) |
| ***A47C 1/03*** | (2006.01) |
| ***A47C 1/04*** | (2006.01) |

(52) U.S. Cl.

CPC ..... *A47C 1/11* (2013.01); *A47C 1/03* (2013.01); *A47C 1/04* (2013.01); *A47C 1/06* (2013.01); *A47C 7/543* (2013.01); *A47K 3/022* (2013.01); *A61H 35/006* (2013.01); *E03C 1/14* (2013.01)

(58) Field of Classification Search

CPC ..... A47K 3/022

USPC ..... 4/621–622

See application file for complete search history.

(56) References Cited

U.S. PATENT DOCUMENTS

2007/0226897 A1 10/2007 Fugate
2007/0228785 A1 10/2007 Fugate et al.

FOREIGN PATENT DOCUMENTS

WO WO2014110411 A1 7/2014

OTHER PUBLICATIONS

International Search Report and Written Opinion of the International Searching Authority, dated Feb. 1, 2017, PCT/US2016/051999.

(Continued)

*Primary Examiner* — Lori Baker

(74) *Attorney, Agent, or Firm* — Roeder & Broder LLP; Steven G. Roeder

(57) ABSTRACT

A salon treatment assembly (10) for use by a user during a salon treatment, comprises a foot bath (16), a salon chair (14), and an adjuster assembly (20). The salon chair (14) supports the user during the salon treatment and is coupled to the foot bath (16). The salon chair (14) can have a chair body (31) including a seat support (28), and an arm rest (32A) that is movably coupled to the seat support (28). The adjuster assembly (20) selectively moves the arm rest (32A) relative to the seat support (28) such that the salon chair (14) is alternatively positioned in a closed configuration, wherein the arm rest (32A) is positioned directly adjacent to a forward portion (28A) of the seat support (28), and an open configuration, wherein the arm rest (32A) is not positioned directly adjacent to the forward portion (28A) of the seat support (28).

20 Claims, 3 Drawing Sheets

(56) References Cited

OTHER PUBLICATIONS

Invitation to Pay Additional Fees and, Where Applicable, Protest Fee; Annex to Form PCT/ISA/206 Communication Relating to the Results of the Partial International Search, dated Dec. 1, 2016, PCT/US2016/051999.
International Preliminary Report on Patentability, dated Mar. 27, 2018, PCT/US2016/051999.

SALON TREATMENT ASSEMBLY WITH MOVABLE SALON CHAIR COUPLED TO HARD-PLUMBED FOOT BATH

RELATED APPLICATION

This application is related to and claims priority on U.S. Provisional Patent Application Ser. No. 62/232,812 filed on Sep. 25, 2015, entitled "SALON TREATMENT ASSEMBLY WITH MOVABLE SALON CHAIR COUPLED TO HARD-PLUMBED FOOT BATH". As far as is permitted, the contents of U.S. Provisional Patent Application Ser. No. 62/232,812 are incorporated herein by reference.

BACKGROUND

As the benefits of various salon treatments are becoming more widely appreciated, more and more people are choosing to receive salon treatments. One such popular salon treatment is the pedicure, which helps people to improve the appearance of their feet and toe nails. A salon treatment assembly, e.g., a pedicure treatment assembly, that may be used when a person is receiving a pedicure typically includes a salon chair, e.g., a pedicure chair, where the person receiving the pedicure is seated, and a foot bath where certain features of the pedicure are performed. Unfortunately, the combination of the pedicure chair and the foot bath often requires a fairly substantial amount of space while the person is receiving the pedicure and even while the person is not receiving the pedicure.

SUMMARY

The present invention is directed toward a salon treatment assembly for use by a user during a salon treatment, such as a pedicure, that is provided relative to a surface. In various embodiments, the salon treatment assembly comprises a foot bath and a salon chair. The salon chair supports the user during the salon treatment. The salon chair is coupled to the foot bath. In such embodiments, the salon chair can have a chair body including a seat support, and a first arm rest that is movably coupled to the seat support. Additionally, the salon treatment assembly can further comprise a first adjuster assembly that selectively moves the first arm rest relative to the seat support such that the salon chair is alternatively positioned in a closed configuration, wherein the first arm rest is positioned directly adjacent to a forward portion of the seat support, and an open configuration, wherein the first arm rest is not positioned directly adjacent to the forward portion of the seat support.

In certain embodiments, the first adjuster assembly can include a first adjuster guide, and the first arm rest can be selectively moved along the first adjuster guide relative to the seat support such that the salon chair is alternatively positioned in the closed configuration and the open configuration. Additionally, in some embodiments, the first adjuster assembly includes (i) a first moving member that is coupled to the first arm rest, and a first stationary member that is coupled to the chair body. In such embodiments, the first adjuster assembly can further include a first adjuster mover that selectively moves the first moving member relative to the first stationary member.

In some embodiments, the first adjuster assembly selectively moves the first arm rest parallel to the surface relative to the seat support such that the salon chair is alternatively positioned in the closed configuration and the open configuration.

In alternative embodiments, the forward portion of the seat support can be at least thirty percent of the seat support, at least fifty percent of the seat support, or another suitable amount of the seat support. With such design, the seating area, i.e. the seat support, is exposed to a user for ease of access onto and off of the salon chair.

In some embodiments, the salon chair further includes a second arm rest that is movably coupled to the seat support. In such embodiments, the first adjuster assembly can selectively move the second arm rest relative to the seat support such that the salon chair is alternatively positioned in the closed configuration, wherein the second arm rest is positioned directly adjacent to the forward portion of the seat support, and the open configuration, wherein the second arm rest is not positioned directly adjacent to the forward portion of the seat support.

The salon treatment assembly can also comprise a second adjuster assembly that selectively moves the salon chair parallel to the surface relative to the foot bath between a first in-use position and a second in-use position. With this design, the salon treatment assembly is able to more comfortably accommodate users of various shapes and sizes.

In some embodiments, the foot bath is fixed in position relative to the surface. For example, the foot bath can be hard-plumbed.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1C:
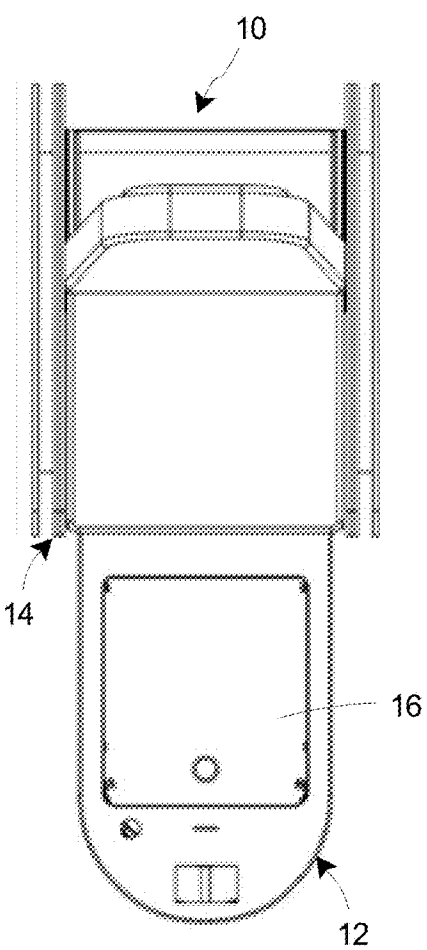
FIG. 1C is a top view of the salon treatment assembly illustrated in FIG. 1A, with the salon chair being in the closed configuration and in a second in-use position relative to the foot bath.
Figure 1B:
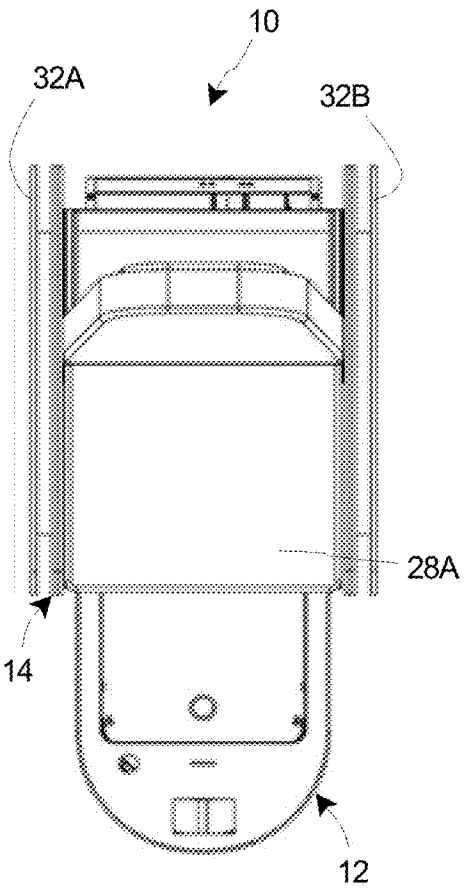
FIG. 1B is a top view of the salon treatment assembly illustrated in FIG. 1A, with the salon chair being in a closed configuration and in a first in-use position relative to the foot bath.
Figure 1A:
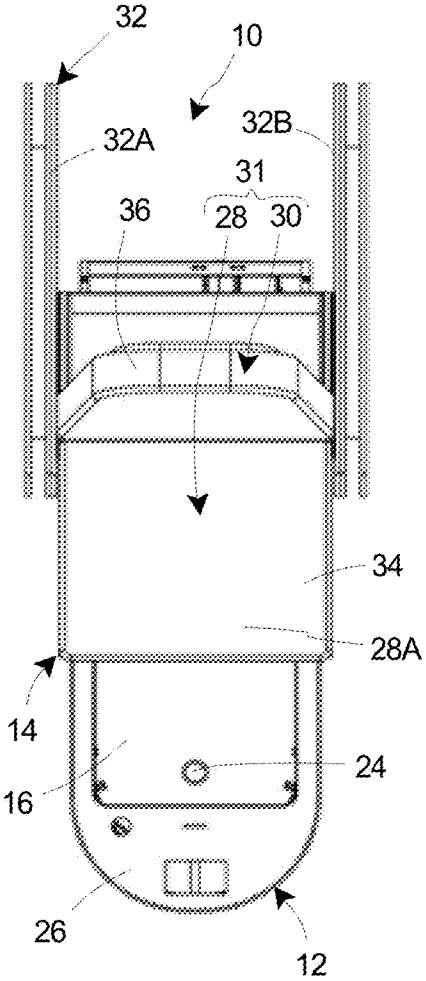
FIG. 1A is a top view of an embodiment of a salon treatment assembly having features of the present invention, the salon treatment assembly including a foot bath and a salon chair, with the salon chair being in an open configuration.

FIG. 1A is a top view of an embodiment of a salon treatment assembly 10 having features of the present invention. The design of the salon treatment assembly 10 can be varied. In certain embodiments, as illustrated in FIG. 1A, the salon treatment assembly 10 includes a foot bath system 12, and a salon chair 14. Alternatively, the salon treatment assembly 10 can have a different design than that illustrated in FIG. 1A.

As an overview, in certain embodiments, the salon treatment assembly 10 is designed to provide a smaller overall footprint, while better enabling a person receiving the salon treatment (sometimes referred to herein as a "user") to access the salon chair 14. More specifically, in such embodiments, the foot bath system 14 can include a foot bath 16 that is hard-plumbed, and/or is fixed and stationary in position relative to a surface 18 (illustrated in FIG. 1D), e.g., a floor or the ground, and the salon chair 14 can be movably coupled to the foot bath 16. Additionally, the salon chair 14 can include a first adjuster assembly 20 (illustrated in FIG. 1G) that selectively moves a portion of the salon chair 14 so that the person receiving the salon treatment can more easily get onto and off of the salon chair 14. Stated in another manner, as provided herein, a portion of the salon chair 14 is selectively movable with the first adjuster assembly 20 such that the salon chair 14 can be selectively moved between an open (accessing) configuration (illustrated, for example, in FIG. 1A) and a closed (treatment) configuration (illustrated, for example, in FIG. 1B). When the salon chair 14 is in the open configuration, the user can easily move onto or off of the salon chair 14. When the salon chair 14 is in the closed configuration, the user can be seated and supported comfortably on the salon chair 14.

Further, in some embodiments, the salon treatment assembly 10 can also include a second adjuster assembly 22 (illustrated in FIG. 1H) that selectively moves the salon chair 14 along a chair axis 23 relative to the foot bath 16 to provide a more comfortable experience for the person receiving the salon treatment. More particularly, the second adjuster assembly 22 can be utilized to selectively move the salon chair 14 forward or backward along a chair axis 23 relative to the foot bath 16 depending on the size or height of the person receiving the salon treatment.

It should be appreciated that the use of the terms "first adjuster assembly" and "second adjuster assembly" is merely for convenience and ease of illustration, and either adjuster assembly 20, 22 can be referred to as the "first adjuster assembly" and/or the "second adjuster assembly".

The size, shape, dimensions and design of the foot bath system 12, and the various components of the foot bath system 12, can be varied as desired, e.g., for various functional and/or aesthetic reasons. For example, the design of the foot bath system 12 can be varied to suit the specific requirements of the salon treatment assembly 10. As noted above, in various embodiments, the foot bath system 12 includes the foot bath 16 that is hard-plumbed, and/or is fixed and stationary in position relative to the surface 18. For example, the foot bath system 12 and/or the foot bath 16 can be mounted on, above and/or within the surface 18 along which the salon chair 14 moves. Additionally, the foot bath system 12 and/or the foot bath 16 can be mounted, at least in part, above and/or within a surface aperture 18A (illustrated in phantom in FIG. 1D), such that the foot bath 16 can be hard-plumbed with access to fixed plumbing features, e.g., water pipes, drain pipes, etc., that enable water to be selectively added to and/or drained from the foot bath 16. Alternatively, in one embodiment, the foot bath 16 can have access to flexible plumbing features that allow for certain movements of the foot bath 16 relative to the surface 18.

The foot bath 16 can retain a volume of water, and can provide a place for the person receiving the salon treatment to position their feet during the performance of certain features of the salon treatment, e.g., the pedicure. In certain embodiments, the foot bath system 12 can include (i) a water control mechanism (not shown), which controls the adding of a volume of hot and/or cold water to the foot bath 16 by selectively turning on the hot and/or cold water; and (ii) a drain control mechanism (not shown), which controls the removal, i.e. draining, of a volume of the water from the foot bath 16 by selectively opening a drain 24 at a base of the foot bath 16. It should be appreciated that the water control mechanism and the drain control mechanism can be positioned in any suitable location for purposes of providing the desired control of adding water to and/or draining water from the foot bath 16. Alternatively, the foot bath 16 can be non-plumbed, such that water has to be manually added to and/or removed from the foot bath 16, i.e. without the use of a water control mechanism and/or a drain control mechanism. Still alternatively, the drain 24 can be controlled in a different manner.

Additionally, in certain embodiments, the foot bath system 12 can further include a foot rest (not shown) that is coupled to the foot bath 16. The foot rest can be positioned substantially adjacent to a ledge 26 positioned around the top of the foot bath 16. In some such embodiments, the foot rest can be selectively adjustable such that the foot rest can be positioned in multiple alternative positions relative to the ledge 22 to suit the desired comfort of the person receiving the salon treatment, e.g., when one or both of the user's feet are not positioned within the foot bath 16. Alternatively, the foot bath system 12 can have a different design, e.g., the foot bath system 12 can be designed without a foot rest.

The salon chair 14, e.g., a pedicure chair, is designed to support a person relative to the surface 18 while the person is receiving a salon treatment, e.g., a pedicure treatment. Additionally, the salon chair 14 is movably coupled to the foot bath 16. The size, shape, dimensions and design of the salon chair 14 can be varied as desired, e.g., for various functional and/or aesthetic reasons. As shown in FIG. 1A, the salon chair 14 can include a seat support 28 and a back support 30 (also referred to herein collectively as a "chair body" 31), and an arm assembly 32; as well as the first adjuster assembly 20 and the second adjuster assembly 22. The design of each of these components can be varied depending on the specific requirements of the salon treatment assembly 10. Alternatively, the salon chair 14 can have a different design than that illustrated in FIG. 1A.

The seat support 28 supports the backside of the person receiving the salon treatment when the person is positioned on the salon chair 14. The design of the seat support 28 can be varied to suit the specific requirements of the salon chair 14 and/or for the comfort of the person receiving the salon treatment. In certain embodiments, the seat support 28 includes a seat support base (not illustrated), a seat pad (not illustrated) that is positioned on the seat support base, and a seat pad cover 34 that is positioned over the seat pad and secures the seat pad to the seat support base. Alternatively, for example, the seat support 28 can be made without the seat pad and/or the seat pad cover 34.

The seat support base is generally rigid and can be made of a rigid material such as wood, aluminum, plastic, or other suitable materials. In certain non-exclusive, alternative embodiments, the seat support base can have a thickness of approximately 0.50, 0.75, 1.00, 1.25, 1.50, 1.75, 2.00, 2.25 or 2.50 centimeters. However, other thicknesses for the seat support base can also be utilized.

The seat pad provides a cushion for the comfort of the person seated on the salon chair 14. Non-exclusive examples of suitable materials for the seat pad include foam, memory foam, fleece pads, etc. Additionally, the seat pad can be made any desired thickness.

The seat pad cover 34 secures the seat pad to the seat support base and provides a protective covering for the seat pad. Non-exclusive examples of suitable materials for the seat pad cover 34 include leather, vinyl, plastic, and cloth.

The back support 30 can support the back of the person receiving the salon treatment when the person is positioned on the salon chair 14. The design of the back support 30 can be varied to suit the specific requirements of the salon chair 14 and/or for the comfort of the person receiving the salon treatment. As illustrated, in certain embodiments, the back support 30 includes a back support base (not illustrated), a back pad (not illustrated) that is positioned on the back support base, and a back pad cover 36 that is positioned over the back pad and secures the back pad to the back support base. Alternatively, for example, the back support 30 can be made without the back pad and/or the back pad cover 36.

The back support base is generally rigid and can be made of a rigid material such as wood, aluminum, plastic, or other suitable materials. In certain non-exclusive, alternative embodiments, the back support base has a thickness of approximately 0.50, 0.75, 1.00, 1.25, 1.50, 1.75, 2.00, 2.25 or 2.50 centimeters. However, other thicknesses for the back support base can also be utilized.

The back pad provides a cushion for the comfort of the person seated on the salon chair 14. Non-exclusive examples of suitable materials for the back pad include foam, memory foam, fleece pads, etc. Additionally, the back pad can be made any desired thickness.

The back pad cover 36 secures the back pad to the back support base and provides a protective covering for the back pad. Non-exclusive examples of suitable materials for the back pad cover 36 include leather, plastic, and cloth.

Additionally, in some embodiments, the back support 30 can be adjustably, e.g., hingedly, secured and/or coupled to the seat support 28 such that the back support 30 can be rotated, i.e. tilted, relative to the seat support 28 by any suitable amount. Alternatively, the salon chair 14 can be designed so that the back support 30 does not tilt relative to the seat support 28.

The arm assembly 32 can support the arms of the person receiving the salon treatment when the person is positioned on the salon chair 14. Additionally, the arm assembly 32 is movably coupled to the seat support 28. The design of the arm assembly 32 can be varied to suit the specific requirements of the salon chair 14 and/or for the comfort of the person receiving the salon treatment. For example, in certain embodiments, the arm assembly 32 includes a first (right) arm rest 32A and a second (left) arm rest 32B.

As provided herein, the first adjuster assembly 20 can selectively move the first arm rest 32A and/or the second arm rest 32B relative to the seat support 28 and/or the back support 30 of the salon chair 14. More particularly, the first adjuster assembly 20 can selectively move one or both of the arm rests 32A, 32B horizontally and/or parallel to the surface 18 along the chair axis 23 (illustrated in FIG. 1H) relative to the seat support 28 and/or the back support 30 (i.e. relative to the chair body 31) between (i) a rearward-most position, where the salon chair 14 is in the open (accessing) configuration; and (ii) a forward-most position, where the salon chair 14 is in the closed (treatment) configuration. In the embodiment illustrated in FIG. 1A, both arm rests 32A, 32B have been selectively moved to the rearward-most position, such that the salon chair 14 is in the open configuration.

As shown in FIG. 1A, when the salon chair 14 is in the open configuration, one or both of the arm rests 32A, 32B are not positioned directly adjacent to a forward portion 28A (e.g., at least approximately twenty percent, thirty percent, forty percent, fifty percent, sixty percent, seventy percent, eighty percent, or another amount) of the seat support 28, and the user can have easy accessibility onto and off of the seat support 28 of the salon chair 14. More specifically, with both arm rests 32A, 32B being selectively moved to the rearward-most position, the user can have easy accessibility onto and off of the seat support 28 of the salon chair 14 on either side of the salon chair 14. In alternative applications, the user can be restricted to getting onto or off the seat support 28 on only one side of the salon chair 14 when only one or the arm rests 32A, 32B has been selectively moved to the rearward-most position.

Previous salon treatment assemblies presented some difficulty for the user in getting into an appropriate seated position prior to the beginning of a procedure and subsequently getting back into a standing position after the procedure is completed. Thus, in an effort to address both issues, the salon chair 14 includes the first adjuster assembly 20 that slides the arm rests 32A, 32B toward the rear of the salon chair 14. This exposes the seating area, i.e. the seat support 28, for ease of access.

Additionally, in certain embodiments, the height of the salon chair 14, i.e. the height of the seat support 28, is shorter or lower to the surface 18 than typical salon chairs of a similar application. The shorter height addresses ADA standards thus delivering access to a broader range of individuals. For example, the height can be approximately nineteen inches. However, other heights are possible.

FIG. 1B is another top view of the salon treatment assembly 10 illustrated in FIG. 1A. In particular, FIG. 1B is a top view of the foot bath system 12 and the salon chair 14. Additionally, as illustrated in FIG. 1B, one or both of the arm rests 32A, 32B have been moved horizontally and/or parallel to the surface 18 (illustrated in FIG. 1D) with the first adjuster assembly 20 (illustrated in FIG. 1G) relative to the rest of the salon chair 14 to the forward-most position such that the salon chair 14 is now in the closed (treatment) configuration. More specifically, the arm rests 32A, 32B are now positioned directly adjacent to the forward portion 28A of the seat support 28 so as to provide a place for the person receiving the salon treatment to comfortably rest their arms while receiving the salon treatment.

Further, as shown in FIG. 1B, the salon chair 14 is in a first in-use position relative to the foot bath 16. In particular, the salon chair 14 is in a forward-most position relative to the foot bath 16 to provide a more comfortable experience for shorter and/or smaller people who may be receiving a salon treatment.

FIG. 1C is a still another top view of the salon treatment assembly 10 illustrated in FIG. 1A. In particular, FIG. 1C is another top view of the foot bath system 12 and the salon chair 14. Additionally, FIG. 1C again illustrates the salon chair 14 being in the closed (treatment) configuration. Further, as shown in FIG. 1C, the salon chair 14 is in a second in-use position relative to the foot bath 16. In particular, the salon chair 14 has been moved along and/or parallel to the surface 18 (illustrated in FIG. 1D) to a rearward-most position relative to the foot bath 16 to provide a more comfortable experience for taller and/or larger people who may be receiving a salon treatment.

Figure 1D:
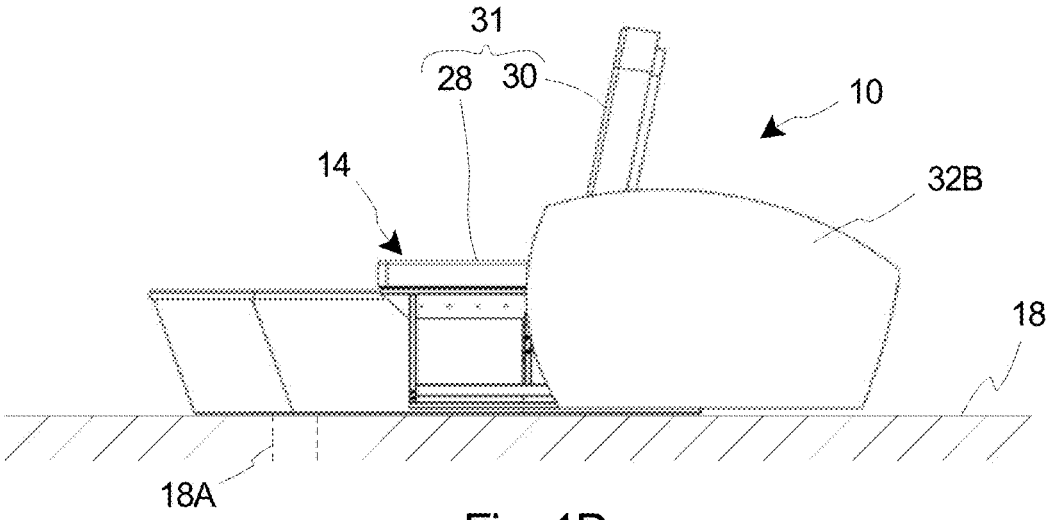
FIG. 1D is a side view of the salon treatment assembly illustrated in FIG. 1A, with the salon chair being in the open configuration.
Figure 1E:
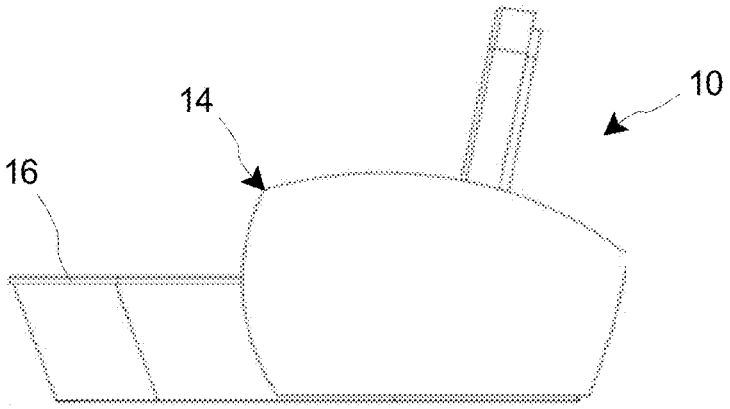
FIG. 1E is a side view of the salon treatment assembly illustrated in FIG. 1A, with the salon chair being in the closed configuration and in the first in-use position relative to the foot bath.
Figure 1F:
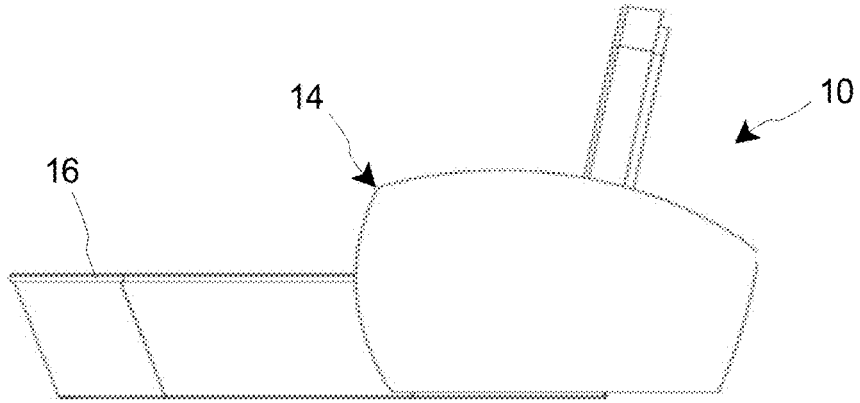
FIG. 1F is a side view of the salon treatment assembly illustrated in FIG. 1A, with the salon chair being in the closed configuration and in the second in-use position relative to the foot bath.
Figure 1G:
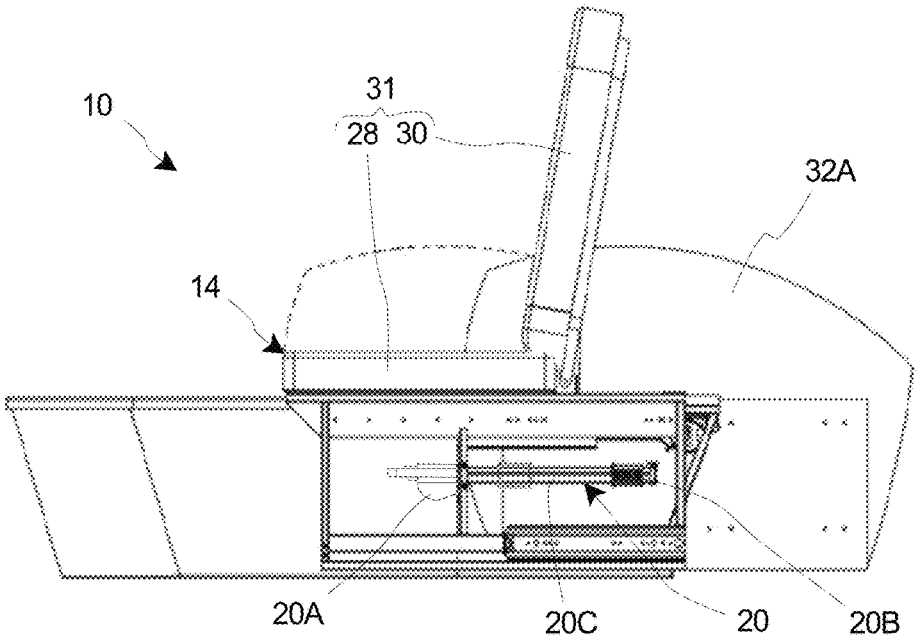
FIG. 1G is a side view of a portion of the salon treatment assembly illustrated in FIG. 1A, with the salon chair being in the open configuration.
Figure 1H:
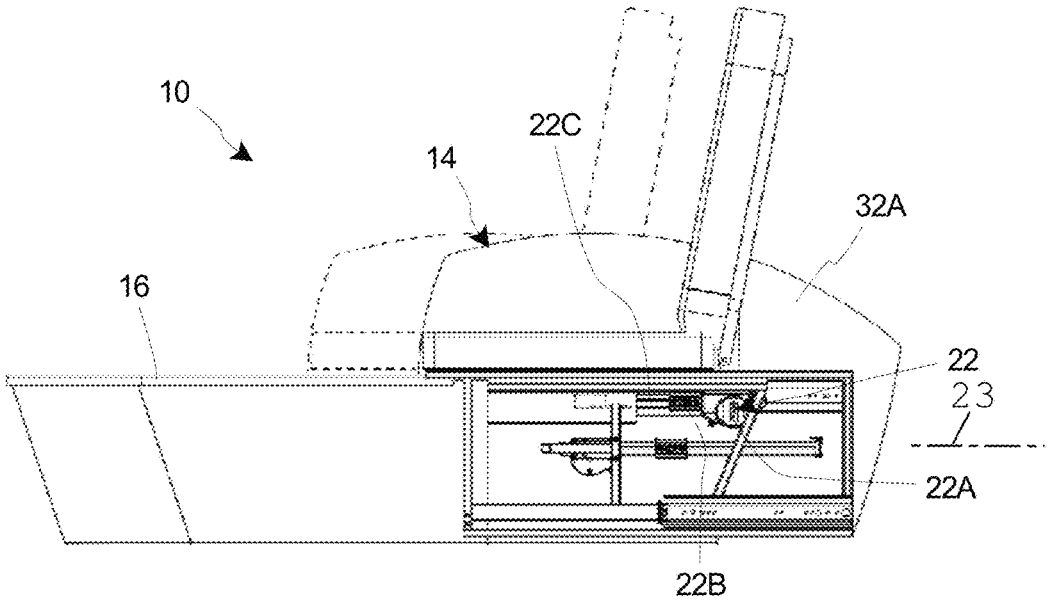
FIG. 1H is a side view of the portion of the salon treatment assembly illustrated in FIG. 1G, with the salon chair being in the closed configuration and in the second in-use position relative to the foot bath.

As provided herein, the second adjuster assembly 22 (illustrated in FIG. 1H) can be utilized to selectively move the salon chair 14 relative to the foot bath 16 between the first in-use position and the second in-use position along the chair axis 23 (illustrated in FIG. 1H).

It should be appreciated that the salon chair 14 can be selectively positioned in any suitable and desired position relative to the foot bath 16 from and between the first in-use position and the second in-use position. In certain embodiments, the salon chair 14 can be positioned in multiple discrete positions from and between the first in-use position and the second in-use position. Alternatively, in other embodiments, the salon chair 14 can be infinitely adjustable to any suitable position along a continuum from and between the first in-use position and the second in-use position.

Additionally, it should also be understood that the specific designation of a "first in-use position" and a "second in-use position" is merely for convenience and ease of illustration, and any of the positions of the salon chair 14 relative to the foot bath 16 can be referred to as a "first in-use position" and/or a "second in-use position".

FIG. 1D is a side view of the salon treatment assembly 10 illustrated in FIG. 1A. As shown, the arm rests 32A, 32B (only the second arm rest 32B is visible in FIG. 1D) are again in the rearward-most position relative to the seat support 28 and/or the back support 30, i.e. relative to the chair body 31, such that the salon chair 14 is in the open configuration.

Additionally, as noted above, FIG. 1D also illustrates the salon treatment assembly 10 being positioned above and being supported by the surface 18. Further, the foot bath 16 is shown as being hard-plumbed, and/or in a fixed and stationary position relative to the surface 18. More specifically, the foot bath system 12 and/or the foot bath 16 are shown as being mounted on, above and/or within the surface 18; and, at least in part, above and/or within the surface aperture 18A.

FIG. 1E is another side view of the salon treatment assembly 10 illustrated in FIG. 1A. As shown in FIG. 1E, the salon chair 14 is again in the closed configuration and in the first in-use position relative to the foot bath 16.

FIG. 1F is still another side view of the salon treatment assembly 10 illustrated in FIG. 1A. As shown in FIG. 1F, the salon chair 14 is in the closed configuration and in the second in-use position relative to the foot bath 16.

FIG. 1G is a side view of a portion of the salon treatment assembly 10 illustrated in FIG. 1A. More specifically, FIG. 1G is a side view of the salon treatment assembly 10 substantially similar to what is shown in FIG. 1D, only with the second arm rest 32B having been omitted for purposes of clarity. In particular, the second arm rest 32B has been omitted from FIG. 1G so that the first adjuster assembly 20 can be more clearly illustrated.

As noted above, and as illustrated in FIG. 1G, the arm rests 32A, 32B (as noted, only the first arm rest 32A is shown in FIG. 1G) can be selectively moved with the first adjuster assembly 20 relative to the seat support 28 and/or the back support 30, i.e. relative to the chair body 31, such that the salon chair 14 can be alternatively positioned in the open (accessing) configuration (illustrated in solid lines in FIG. 1G) and the closed (treatment) configuration (illustrated in dashed lines in FIG. 1G). More specifically, the solid lines of the first arm rest 32A show the first arm rest 32A being in the rearward-most position such that the salon chair 14 is in the open configuration. Additionally, the dashed lines of the first arm rest 32A show the first arm rest 32A being in the forward-most position such that the salon chair 14 is in the closed configuration.

The design of the first adjuster assembly 20 can be varied to suit the specific requirements of the salon treatment assembly 10 and/or the salon chair 14. In certain embodiments, as shown in FIG. 1G, the first adjuster assembly 20 includes a first adjuster mover 20A, a first moving member 20B, and a first stationary member 20C. Alternatively, the first adjuster assembly 20 can have a different design. For example, in alternative embodiments, the first adjuster assembly 20 can have more components or fewer components than what is specifically illustrated in FIG. 1G. In one such non-exclusive alternative embodiment, the first adjuster assembly 20 can be designed without the first adjuster mover 20A, and one or both of the arm rests 32A, 32B can be manually moved relative to the seat support 28 and/or the back support 30 (i.e. the chair body 31) between the open configuration and the closed configuration.

The first adjuster mover 20A can have any suitable design. For example, the first adjuster mover 20A can include a worm drive linear motor, a pneumatic piston, a linear motor, or another suitable design. The first adjuster mover 20A can be selectively and independently controlled by the user.

In various embodiments, the first moving member 20B is coupled to one or both of the arm rests 32A, 32B, and the first stationary member 20C is coupled to another portion of the salon chair 14, e.g., to the seat support 28 and/or the back support 30 (i.e. to the chair body 31). The first moving member 20B can further be movably coupled to the first stationary member 20C such that the first moving member 20B can be selectively moved along and/or relative to the first stationary member 20C. In some such embodiments, as shown, the first moving member 20B can be a collar or a sleeve, and the first stationary member 20C can be a guide, e.g., a rail, such that the collar or sleeve 20B can be selectively moved along and/or relative to the guide 20C. Alternatively, the first moving member 20B and/or the first stationary member 20C can have a different design. For example, in one such alternative embodiment, the first moving member 20B can be a guide, e.g., a rail, and the first stationary member 20C can be a collar or a sleeve, such that the guide can be selectively moved within and/or relative to the collar or sleeve.

It should be appreciated that the first moving member 20B is illustrated in two alternative positions in FIG. 1G to more clearly demonstrate the movement of the first moving member 20B as the salon chair 14 moves between the open configuration and the closed configuration. In particular, the first moving member 20B is illustrated in solid lines in a rearward-most position relative to the first stationary member 20C, i.e. when the arm rests 32A, 32B have been moved back such that the salon chair 14 is in the open configuration. Additionally, the first moving member 20B is illustrated in dashed lines in a forward-most position relative to the first stationary member 20C, i.e. when the arm rests 32A, 32B have been moved forward such that the salon chair 14 is in the closed configuration.

During use of the first adjuster assembly 20, the first adjuster mover 20A is a linear mover that selectively moves the first moving member 20B along and/or relative to the first stationary member 20C. Thus, with the coupling arrangement described above, the first adjuster assembly 20 selectively moves one or both of the arm rests 32A, 32B linearly along and/or relative to the seat support 28 and/or the back support 30 such that the salon chair 14 can be alternatively positioned in the open configuration and the closed configuration. It should be appreciated that in certain embodiments, the first adjuster assembly 20 can include a separate first adjuster mover 20A, first moving member 20B and first stationary member 20C for each of the individual arm rests 32A, 32B. With such design, each of the arm rests 32A, 32B can be moved independently of one another relative to the seat support 28 and/or the back support 30.

FIG. 1H is a side view of the portion of the salon treatment assembly 10 illustrated in FIG. 1G, with the second arm rest 32B again being omitted for purposes of clarity. More specifically, FIG. 1H is a side view of the salon treatment assembly 10 substantially similar to what is shown in FIG. 1F, only with the second arm rest 32B having been omitted so that the second adjuster assembly 22 can be more clearly illustrated.

Similar to what was shown in FIG. 1F, in FIG. 1H the salon treatment assembly 10 is illustrated with the arm rests 32A, 32B (as noted, only the first arm rest 32A is shown in FIG. 1H) being in the forward-most position such that the salon chair 14 is in the closed configuration.

Additionally, as noted above, and as illustrated in FIG. 1H, the salon chair 14 can be selectively moved with the second adjuster assembly 22 relative to the foot bath 16 between the first in-use position (illustrated in dashed lines in FIG. 1H) and the second in-use position (illustrated in solid lines in FIG. 1H). More specifically, the dashed lines of the salon chair 14 show the salon chair 14 being in the forward-most, first in-use position relative to the foot bath 16. Additionally, the solid lines of the salon chair 14 show the salon chair 14 being in the rearward-most, second in-use position relative to the foot bath 16.

The design of the second adjuster assembly 22 can be varied to suit the specific requirements of the salon treatment assembly 10 and/or the salon chair 14. In certain embodiments, as shown in FIG. 1H, the second adjuster assembly 22 includes a second adjuster mover 22A, a second moving member 22B, and a second stationary member 22C. Alternatively, the second adjuster assembly 22 can have a different design. For example, in alternative embodiments, the second adjuster assembly 22 can have more components or fewer components than what is specifically illustrated in FIG. 1H. In one such non-exclusive alternative embodiment, the second adjuster assembly 22 can be designed without the second adjuster mover 22A, and the salon chair 14 can be moved manually relative to the foot bath 16 between the first in-use position and the second in-use position.

The second adjuster mover 22A can have any suitable design. For example, the second adjuster mover 22A can include a worm drive linear motor, a pneumatic piston, a linear motor, or another suitable design. The second adjuster mover 22A can be selectively and independently controlled by the user.

In various embodiments, the second moving member 22B is coupled to the salon chair 14, and the second stationary member 22C is coupled to the foot bath 16. The second moving member 22B can further be movably coupled to the second stationary member 22C such that the second moving member 22B can be selectively moved along and/or relative to the second stationary member 22C. In some such embodiments, as shown, the second moving member 22B can be a collar or a sleeve, and the second stationary member 22C can be a guide, e.g., a rail, such that the collar or sleeve 22B can be selectively moved along and/or relative to the guide 22C. Alternatively, the second moving member 22B and/or the second stationary member 22C can have a different design. For example, in one such alternative embodiment, the second moving member 22B can be a guide, e.g., a rail, and the second stationary member 22C can be a collar or a sleeve, such that the guide can be selectively moved within and/or relative to the collar or sleeve.

It should be appreciated that the second moving member 22B is illustrated in two alternative positions in FIG. 1H to more clearly demonstrate the movement of the second moving member 22B as the salon chair 14 moves between the first in-use position and the second in-use position. In particular, the second moving member 22B is illustrated in solid lines in a rearward-most position relative to the second stationary member 22C, i.e. when the salon chair 14 has been moved back relative to the foot bath 16 such that the salon chair 14 is in the second in-use position. Additionally, the second moving member 22B is illustrated in dashed lines in a forward-most position relative to the second stationary member 22C, i.e. when the salon chair 14 has been moved forward relative to the foot bath 16 such that the salon chair 14 is in the first in-use position.

During use of the second adjuster assembly 22, the second adjuster mover 22A selectively moves the second moving member 22B along and/or relative to the second stationary member 22C. Thus, with the coupling arrangement described above, the second adjuster assembly 22 selectively moves the salon chair 14 relative to the foot bath 16 between the first in-use position and the second in-use position. It should be appreciated that in certain embodiments, the second adjuster assembly 22 can include more than one second adjuster mover 22A, more than one second moving member 22B, and/or more than one second stationary member 22C to enable smoother and more balanced movement of the salon chair 14 relative to the foot bath 16.

It is understood that although a number of different embodiments of the salon treatment assembly 10 have been illustrated and described herein, one or more features of any one embodiment can be combined with one or more features of one or more of the other embodiments, provided that such combination satisfies the intent of the present invention.

While a number of exemplary aspects and embodiments of a salon treatment assembly 10 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A salon treatment assembly for use by a user during a salon treatment that is provided relative to a surface, the salon treatment assembly comprising:

a foot bath;

a salon chair that supports the user during the salon treatment, the salon chair being coupled to the foot bath, the salon chair having a chair body including a seat support, and a first arm rest that is movably coupled to the seat support;

a first adjuster assembly that selectively moves the first arm rest relative to the seat support such that the salon chair is alternatively positioned in a closed configuration, wherein the first arm rest is positioned directly adjacent to a forward portion of the seat support, and an open configuration, wherein the first arm rest is not positioned directly adjacent to the forward portion of the seat support; and wherein the first adjuster assembly includes (i) a first moving member that is coupled to the first arm rest, and (ii) a first stationary member that is coupled to the chair body; and a second adjuster assembly that selectively moves the salon chair parallel to the surface relative to the foot bath such that the salon chair is alternatively positioned in a first in-use position and a second in-use position.

2. The salon treatment assembly of claim 1 wherein the first adjuster assembly selectively moves the first arm rest parallel to the surface relative to the seat support such that the salon chair is alternatively positioned in the closed configuration and the open configuration.

3. The salon treatment assembly of claim 1 wherein the forward portion of the seat support is at least thirty percent of the seat support.

4. The salon treatment assembly of claim 1 wherein the forward portion of the seat support is at least fifty percent of the seat support.

5. The salon treatment assembly of claim 1 wherein the salon chair further includes a second arm rest that is movably coupled to the seat support; and wherein the first adjuster assembly selectively moves the second arm rest relative to the seat support such that the salon chair is alternatively positioned in the closed configuration, wherein the second arm rest is positioned directly adjacent to the forward portion of the seat support, and the open configuration, wherein the second arm rest is not positioned directly adjacent to the forward portion of the seat support.

6. The salon treatment assembly of claim 5 wherein the first adjuster assembly selectively moves the first arm rest and the second arm rest substantially simultaneously relative to the seat support as the salon chair is being moved between the closed configuration and the open configuration.

7. The salon treatment assembly of claim 1 wherein the foot bath is fixed in position relative to the surface.

8. The salon treatment assembly of claim 1 wherein the first adjuster assembly includes a first adjuster guide, and wherein the first arm rest is selectively moved along the first adjuster guide relative to the seat support as the salon chair is moved between the closed configuration and the open configuration.

9. The salon treatment assembly of claim 1 wherein the first adjuster assembly further includes a first adjuster mover that selectively moves the first moving member relative to the first stationary member.

10. A salon treatment assembly for use by a user during a salon treatment that is provided relative to a surface, the salon treatment assembly comprising:

a foot bath;

a salon chair that supports the user during the salon treatment, the salon chair being coupled to the foot bath, the salon chair having a chair body including a seat support, and a first arm rest that is movably coupled to the seat support; and a first adjuster assembly that selectively moves the first arm rest relative to the seat support such that the salon chair is alternatively positioned in a closed configuration, wherein the first arm rest is positioned directly adjacent to a forward portion of the seat support, and an open configuration, wherein the first arm rest is not positioned directly adjacent to the forward portion of the seat support; wherein the first adjuster assembly includes a first adjuster guide, and wherein the first arm rest is selectively moved linearly along the first adjuster guide relative to the seat support as the salon chair is moved between the closed configuration and the open configuration.

11. The salon treatment assembly of claim 10 wherein the first adjuster assembly selectively moves the first arm rest parallel to the surface relative to the seat support such that the salon chair is alternatively positioned in the closed configuration and the open configuration.

12. The salon treatment assembly of claim 10 wherein the salon chair further includes a second arm rest that is movably coupled to the seat support; and wherein the first adjuster assembly selectively moves the second arm rest relative to the seat support such that the salon chair is alternatively positioned in the closed configuration, wherein the second arm rest is positioned directly adjacent to the forward portion of the seat support, and the open configuration, wherein the second arm rest is not positioned directly adjacent to the forward portion of the seat support.

13. The salon treatment assembly of claim 12 wherein the first adjuster assembly selectively moves the first arm rest and the second arm rest substantially simultaneously relative to the seat support as the salon chair is being moved between the closed configuration and the open configuration.

14. The salon treatment assembly of claim 10 wherein the foot bath is hard-plumbed so as to be fixed in position relative to the surface.

15. A salon treatment assembly for use by a user during a salon treatment that is provided relative to a surface, the salon treatment assembly comprising:

a foot bath;

a salon chair that supports the user during the salon treatment, the salon chair being coupled to the foot bath, the salon chair having a chair body including a seat support, and a first arm rest that is movably coupled to the seat support; and a first adjuster assembly that selectively moves the first arm rest relative to the seat support such that the salon chair is alternatively positioned in a closed configuration, wherein the first arm rest is positioned directly adjacent to a forward portion of the seat support, and an open configuration, wherein the first arm rest is not positioned directly adjacent to the forward portion of the seat support, wherein the first adjuster assembly includes (i) a first moving member that is coupled to the first arm rest, (ii) a first stationary member that is coupled to the chair body, and (iii) a first adjuster mover that selectively moves the first moving member relative to the first stationary member.

16. The salon treatment assembly of claim 15 wherein the first adjuster assembly selectively moves the first arm rest parallel to the surface relative to the seat support such that the salon chair is alternatively positioned in the closed configuration and the open configuration.

17. The salon treatment assembly of claim 15 wherein the salon chair further includes a second arm rest that is movably coupled to the seat support; and wherein the first adjuster assembly selectively moves the second arm rest relative to the seat support such that the salon chair is alternatively positioned in the closed configuration, wherein the second arm rest is positioned directly adjacent to the forward portion of the seat support, and the open configuration, wherein the second arm rest is not positioned directly adjacent to the forward portion of the seat support.

18. The salon treatment assembly of claim 17 wherein the first adjuster assembly selectively moves the first arm rest and the second arm rest substantially simultaneously relative to the seat support as the salon chair is being moved between the closed configuration and the open configuration.

19. The salon treatment assembly of claim 15 wherein the foot bath is fixed in position relative to the surface.

20. The salon treatment assembly of claim 10 wherein the first adjuster assembly includes (i) a first moving member that is coupled to the first arm rest, (ii) a first stationary member that is coupled to the chair body, and (iii) a first adjuster mover that selectively moves the first moving member relative to the first stationary member.

* * * * *